United States Patent [19]

Peterson

[11] Patent Number: 4,832,094

[45] Date of Patent: May 23, 1989

[54] ELECTRIC WATERBED PUMP

[76] Inventor: Michael Peterson, P.O. Box 255, Mt. Vernon, Ill. 62864

[21] Appl. No.: 63,979

[22] Filed: Jun. 18, 1987

[51] Int. Cl.[4] ..... B65B 3/04

[52] U.S. Cl. ..... 141/65; 141/98; 141/382; 141/313; 5/451; 5/455

[58] Field of Search ..... 5/451, 453, 455; 141/1, 141/65, 311 R, 98, 313, 382; 248/150, 175

[56] References Cited

U.S. PATENT DOCUMENTS

| | | | |
|---|---|---|---|
| 1,105,985 | 8/1914 | McClymont | 417/151 |
| 1,212,004 | 1/1917 | Berg | 417/181 |
| 1,232,883 | 7/1917 | Armstrong | 417/181 |
| 1,615,209 | 1/1927 | Asselin | 248/175 |
| 2,928,353 | 3/1960 | Murray | 417/475 |
| 3,456,270 | 7/1969 | Weinstein | 5/451 |
| 3,470,826 | 10/1969 | Foulds | 417/181 |
| 3,797,538 | 3/1974 | Mollura | 141/313 |
| 3,829,248 | 8/1974 | Bright et al. | 417/410 |
| 4,142,263 | 3/1979 | Pierson | 5/453 X |
| 4,175,666 | 11/1979 | Smith | 248/150 X |
| 4,212,335 | 7/1980 | Bova | 141/382 |
| 4,316,489 | 2/1982 | Price | 141/1 |
| 4,332,044 | 7/1982 | Houk, Jr. | 5/453 |
| 4,386,638 | 6/1983 | Hall et al. | 141/98 |
| 4,399,576 | 8/1983 | Callaway | 5/451 |
| 4,407,641 | 10/1983 | Long | 417/410 |
| 4,673,010 | 6/1987 | Prufer et al. | 141/382 |

*Primary Examiner*—Ernest G. Cusick
*Attorney, Agent, or Firm*—Don Weber

[57] ABSTRACT

An electric waterbed pump is presented comprising an electric pump having outlet and inlet tubes, a cord for attaching the pump to electricity, and a stabilizing base capable of holding the apparatus in an essentially upright position as the waterbed deflates. The pump is especially adapted to drain waterbeds and is of increased efficiency due to the use of electrical force in the pumping procedure.

5 Claims, 2 Drawing Sheets

ELECTRIC WATERBED PUMP

BACKGROUND OF THE INVENTION

Waterbeds have been in widespread use for many years and consist generally of a flexible, hollow plastic shell and a supporting frame. Waterbeds support the weight of a human body at all points and were first developed for medical use, although they have now gained common acceptance for residential use.

Much development in the use, care, and added accessories for waterbeds has taken place. A fundamental and long-standing problem in the sale and ownership of a waterbed has been in draining the water from the mattress. A number of new inventions have been patented concerning the draining of waterbeds, but these innovations have involved syphon or Venturi type pumps. Examples of such waterbed pumps are found in the U.S. Pat. Nos. of Mollura (3,797,538); Houk (4,332,044) and Callaway (4,399,576). Each of these inventions advanced the art of draining waterbeds, but each failed to provide for any type of electrically assisted pumping.

Heretofore, the normal draining operation of a waterbed could take anywhere from 2 to 6 hours by use of the syphon method. The more efficient pumps require two long hoses to stretch between the waterbed drain-filler neck and a suitable sink, bathtub, or outside drain and uses a large amount of tap water to facilitate the syphoning process. Because a syphon pump requires the drawing of a partial vacuum, the hoses used in these procedures also had to be rigid.

The new innovation presented here includes an electrically enhanced pump. Because of the nature of an electric pump, moreover, a base or boot has been adapted to keep the electric pump in an upright position on the waterbed as the waterbed deflates from the removal of water therefrom.

Although large sized electric bilge pumps have been borrowed from the boat field, these larger pumps are not commercially practical for the average consumer. What was needed heretofore was a light weight yet highly efficient and economical electric waterbed pump. To enable the commercialization of such a pump especially adapted to the waterbed industry, certain modification of existing pump and pumping art are presented herein.

A primary purpose of this invention is to provide a lightweight, highly efficient and economical pump particularly adapted for use on waterbeds.

Another purpose is to provide a commercially feasible pump for a waterbed capable of draining a waterbed in a short period of time, usually under two hours, using electromotive force.

A still further object of the invention is to provide a base or boot for the lightweight waterbed pump that enables said pump to remain in an upright position as the waterbed draws.

Further objects of this invention will become obvious upon reviewing the specification herewith.

DESCRIPTION OF THE PREFERRED EMBODIMENTS

Figure 1:
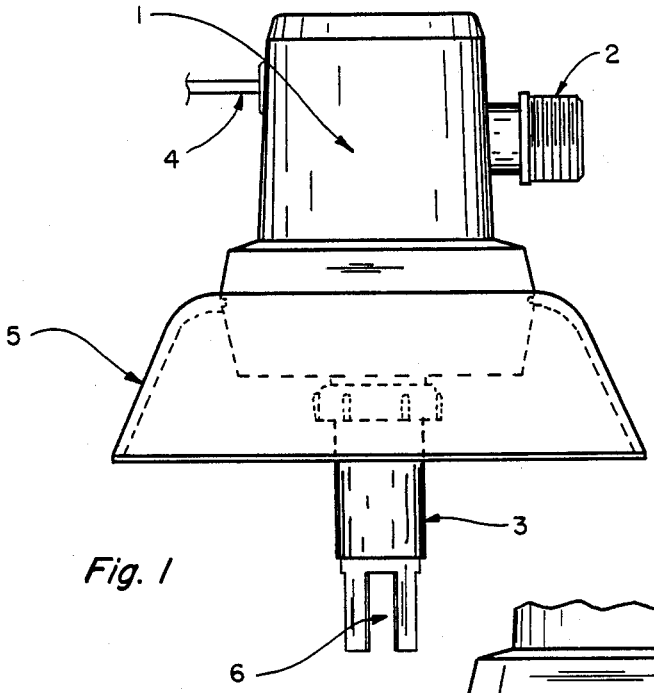
FIG. 1 is a front view of the electric waterbed pump showing the preferred embodiment of the invention.
Figure 2:
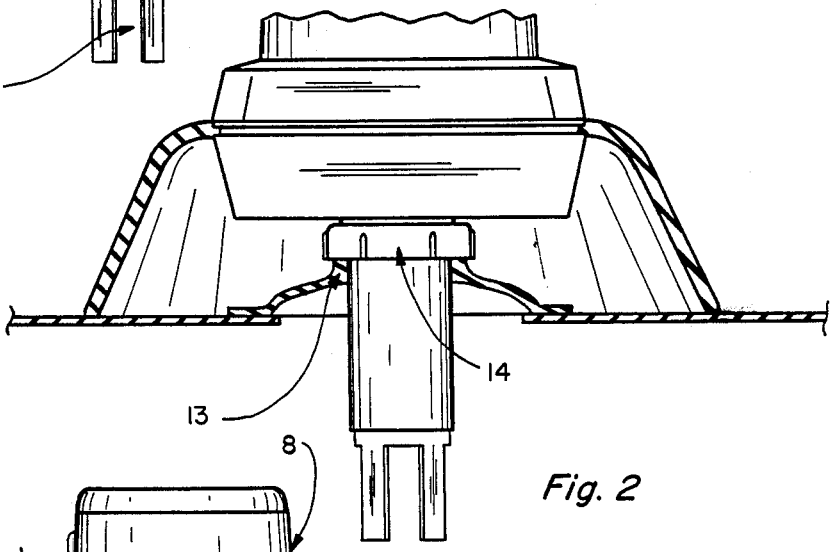
FIG. 2 is a front cut-away view of the apparatus as it is used in draining a waterbed, showing the waterbed filler-neck and attached inlet tube.
Figure 3:
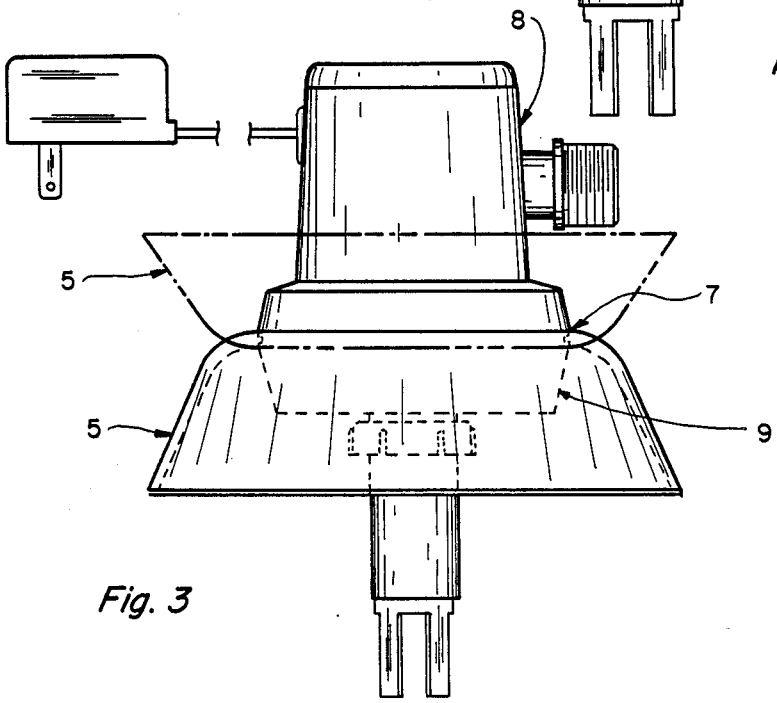
FIG. 3 is a front view of the electric waterbed pump showing an embodiment having an inflexible boot as a base.

As shown in the accompanying drawings, this new invention comprises essentially five main parts. The basic components shown in FIG. 1, are a pump 1 which has attached to it an outlet tube 2 and an inlet tube 3. A cord 4 facilitates the hook-up of the pump to the source of electromotive power, which may be either direct current or alternating current and can be ordinary household 100 V electromotive power. A final and most important component is the base 5 which is attached to the pump and supports the apparatus.

The pump embodied in this invention must be capable of pumping out the water from a waterbed at a fast yet efficient rate. Because of the nature of the waterbed art, low voltages are preferred. One embodiment has a 12 volt AC adapter. It has been found that the adapter is needed if the waterbed pump is used on normal 110 volt AC current. However, the pump will also function well on 110 volt AC current without an adapter. It has been found that the Mayfair 1260 Pump manufactured by May Fair Molded Products Corporation, Schiller Park, Illinois is a suitable pump. This pump operates on 12 volts DC and will discharge approximately 478 gallons per hour. Other suitable pumps may also be interchangeably used, for example, Gem Marine Products, Inc. BP-1400, which also operates on 12 volts DC but discharges water at the rate of about 1200 gallons per hour (manufactured by Gem Products, Lake City, South Carolina).

Integrally formed in the body of this pump is an outlet and inlet tube. The outlet tube 2 in the preferred embodiment comes off at a 90° and is located near the upper part of the body of the apparatus as shown in FIG. #1. This outlet tube has external male threads. The diameter of the tube and the threads are such that they are compatible with an ordinary garden hose. In practice, the female end of the hose is attached to the outlet tube by the female coupling on the hose.

The inlet tube 3 is also integrally formed with the body of the pump, but comes off in a vertical downward position as shown in FIG. #1. The inlet tube is generally considerably longer than the filler neck of a waterbed and protrudes beneath the upper surface of the waterbed mattress. The lower end of the inlet tube has a plurality of open-ended slots 6 to facilitate draining. The inlet tube tapers downwardly so as to conveniently allow the inlet tube to slide into the waterbed filler neck.

In normal operation, a waterbed filler neck 13 is as shown in FIG. #2 and has external male threads capable of attaching to a gardenhose. However, in our embodiment, a nut-type fitting 14 is placed around the inlet tube, facing downward and having internal female threads thereon. Inside the inlet tube fitting is a suitable washer to facilitate an air-tight and water-tight fitting and to hold the nut on the inlet tube.

An electric cord 4 leads from the body of the electric motor to a suitable adapter and electrical outlet.

In order to keep the apparatus in an essentially upright position as the waterbed deflates a base 5 is attached to the pump body. This base is, preferably, a flexible rubber boot sealedly attached near the bottom of the pump body. In the pumps used herein, this attachment occurs near the seam 7 of the upper 8 and lower 9 pump body parts. A suitable water tight sealant is used to secure the boot to the body and seal same.

In attaching the pumping apparatus to a waterbed, one flips up the flexible boot (shown in dotted lines on FIG. #3) thus exposing the inlet tube and fitting. The inlet tube is inserted into the waterbed filler neck and the inlet tube female fitting 14 is then sealably tightened. The flexible boot is then flipped back downward and the apparatus rests on the boot in an essentially upright position. Because the boot has a broad cross-sectional base, the apparatus is stabilized even though the waterbed deflation process varies the angle of the surface of the mattress. After attaching a drain hose (normally a common garden hose) to the outlet tube and plugging the apparatus into a source of electromotive power, the pumping process may begin.

The above embodiment is the most preferred although other suitable embodiments will perform satisfactorily. The flexible rubber boot described above may be replaced by an inflexible boot made of plastic or similar material. The inflexible boot (shown in FIG. #1) is attached at the same position and in essentially the same manner as is the flexible boot. While the inflexible boot satisfactorily stabilizes the pump body, it creates a problem in that attaching the inlet tube fitting is more cumbersome.

Figure 4:
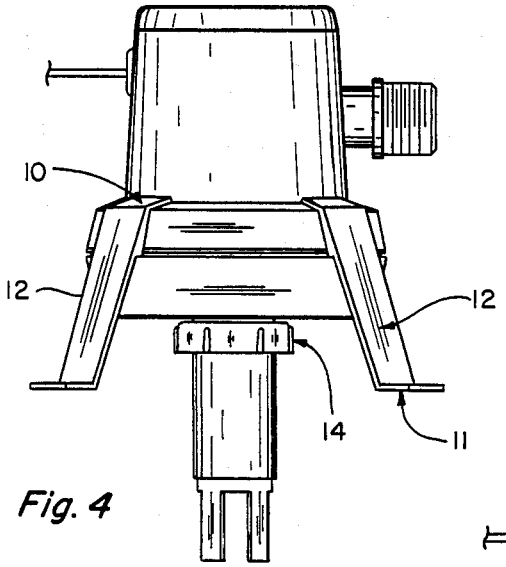
FIG. 4 is a front view of the electric waterbed pump having a plurality of detachable legs as a base.
Figure 5:
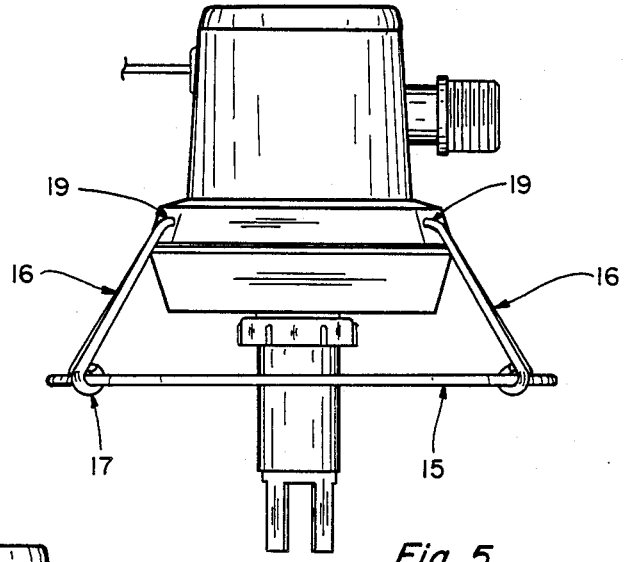
FIG. 5 is a front, exploded view of the electric waterbed pump showing the boss and dimple configuration as a base.
Figure 6:
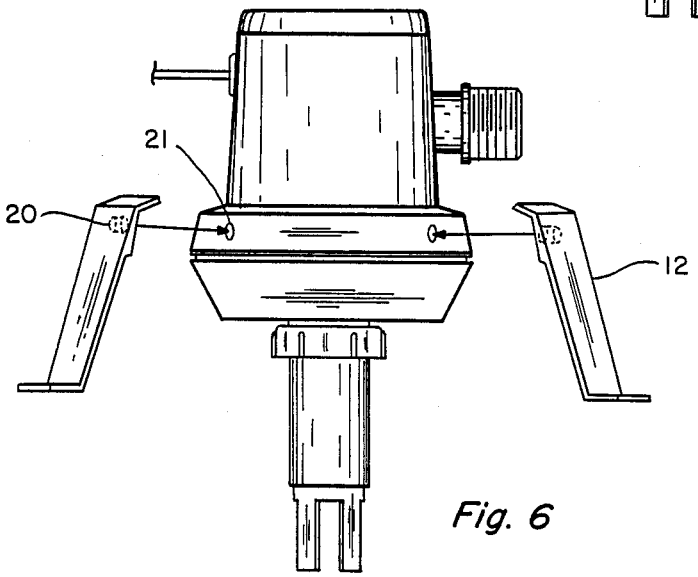

Yet another method of stabilizing the pump body is attaching a plurality of removable plastic legs to the apparatus as shown in FIG. 4. Each leg has an upper 10 and lower 11 horizontal end member and an oblique main member 12. Near the top of the oblique member 12 is a boss 20 which fits into a corresponding dimple 21 on the pump base. The legs thus snap into place and may be readily and easily removed. The legs are arranged at points about the perimeter of the lower base of the pump and are all an equal distance apart. The method of snapping the legs in place by use of a boss and dimple is well known in the art.

Another suitable base consists of a wire ring 15 secured to the pump body by a plurality of braces 16. The braces have a circular lower end 17 which are formed to encircle the wire ring. The upper end of the braces are hooked and are attached to the pump body by inserting the hook into a plurality of suitably located holes 19 in the pump body. The braces are located in the same position as one of the legs in the preceding embodiment.

The precise configuration of the outlet tube and inlet tube are preferred as shown but may be arranged differently. For example, the outlet tube could come out at a 45° angle to the vertical axis of the pump or at any other suitable angle. Similarly, it is preferred but not required that the inlet tube be vertically position downward. The inlet tube could also be at any other suitable angle.

In practice, the outlet and inlet tubes are integrally formed by plastic injection molding or extrusion with the pump base. However, the tubes could also be molded separately and attached to the pump body by suitably connecting the tubes to the proper orifices on the pump body and sealing the corrections appropriately.

The pumps described herein are the preferred types, but other interchangable equivalents may also be utilized. The foregoing description is meant as an illustration and not as a limitation as many various combinations of pumps, attaching angles, types of material and fittings would also be workable.

Having described my invention as above, I now state my claims as follows.

I claim:

1. An electric waterbed pump apparatus for draining waterbeds, comprising:

an electric pump having a pump body defining a side and a bottom, the pump body including an integrally formed malethreaded outlet tube on the side of the pump body, said outlet tube adapted to receive a standard garden hose fitting and an integrally formed inlet tube on the bottom of said pump body, wherein said inlet tube is tapered downwardly and inwardly, said inlet tube also having a plurality of open-ended slots at the lower end of said inlet tube, said inlet tube further comprising a female-threaded nut-type fitting rotatable surrounding said inlet tube;

a cord means for attaching said electric pump to a means of electromotive power; and a base means attached to a lower portion of said pump body and adapted for supporting said apparatus when said apparatus is attached to a waterbed wherein said base means is capable of being temporarily displaced from the lower end of the inlet tube to facilitate connection of the inlet tube to a waterbed filler neck;

whereby said pump may be conveniently and removably attached to the filling neck of a waterbed and will remain upright as the waterbed is pumped out.

2. An electric waterbed pump apparatus for draining waterbeds as in claim 1, wherein said electric pump is of the type operating on low voltage DC current and pumping at least 400 gallons of water per hour.

3. An electric waterbed pump apparatus for draining waterbeds as in claim 1, wherein said base means comprise a flexible boot capable of being temporarily displaced by flipping up and exposing the lower end of the tapered inlet tube to facilitate connection of said inlet tube to a waterbed filler neck.

4. An electric waterbed pump apparatus for draining waterbeds as in claim 1, wherein said pump body has a plurality of dimples therein and wherein said base means comprises a plurality of lightweight removable legs, each leg having an upper and lower horizontal end member and an oblique main member, said oblique main member having a boss near the top thereof which fits into a corresponding dimple on the pump body.

5. An electric waterbed pump apparatus for draining waterbeds as in claim 1, wherein said pump body has a plurality of pump body brace holes and wherein said base means comprises a removable circular wire ring attached to said pump body by means of a plurality of equally spaced braces, each brace having a circular lower end encircling said wire ring and a hooked upper end which is inserted into a corresponding pump body brace hole.

* * * * *